US008399814B2

(12) United States Patent
Stepanian

(10) Patent No.: US 8,399,814 B2
(45) Date of Patent: Mar. 19, 2013

(54) HEATING ASSEMBLIES PROVIDING A HIGH DEGREE OF UNIFORMITY OVER A SURFACE AREA

(75) Inventor: Stella Stepanian, Dix Hills, NY (US)

(73) Assignee: PCK Technology Inc., Islip, NY (US)

( * ) Notice: Subject to any disclaimer, the term of this patent is extended or adjusted under 35 U.S.C. 154(b) by 1077 days.

(21) Appl. No.: 11/927,010

(22) Filed: Oct. 29, 2007

(65) Prior Publication Data

US 2009/0107987 A1 Apr. 30, 2009

(51) Int. Cl.
*H05B 3/44* (2006.01)
*H05B 1/00* (2006.01)

(52) U.S. Cl. ..... 219/544; 219/211; 219/212; 219/217; 219/545; 219/546; 219/548; 219/549; 219/552; 219/553

(58) Field of Classification Search ..... 219/211–212, 219/217, 538, 544–546, 548–549, 552–553
See application file for complete search history.

(56) References Cited

U.S. PATENT DOCUMENTS

| | | | | |
|---|---|---|---|---|
| 2,423,196 | A | 7/1947 | MacKendrick | |
| 3,191,005 | A | 6/1965 | Cox, II | |
| 3,674,602 | A * | 7/1972 | Keogh et al. | 156/433 |
| 3,792,232 | A * | 2/1974 | Zarenko | 219/522 |
| 3,947,618 | A | 3/1976 | Gruss | |
| 4,384,401 | A | 5/1983 | Borrup | |
| 4,817,271 | A | 4/1989 | Altmann et al. | |
| 6,415,501 | B1 | 7/2002 | Schlesselman et al. | |
| 6,492,629 | B1 * | 12/2002 | Sopory | 219/535 |
| 2003/0005212 | A1 | 1/2003 | Cocca | |
| 2003/0052121 | A1 | 3/2003 | Sopory | |
| 2004/0004070 | A1 * | 1/2004 | Sullivan et al. | 219/494 |

OTHER PUBLICATIONS

"What is RFID?" Technovelgy.com Jun. 30, 2008. <http://www.technovelgy.com/ct/Technology-Article.asp?ArtNum=1>.
"How RFID Works." Technovelgy.com Jun. 30, 2008. <http://www.technovelgy.com/ct/Technology-Article.asp?ArtNum=2>.
"What can RFID be used for?" Technovelgy.com Jun. 30, 2008. <http://www.technovelgy.com/ct/Technology-Article.asp?ArtNum=4>.

* cited by examiner

*Primary Examiner* — Shawntina Fuqua
(74) *Attorney, Agent, or Firm* — Fish & Richardson P.C.

(57) ABSTRACT

A uniform heating assembly including at least one first insulative substrate, at least one first common terminal, at least one second common terminal and a multiplicity of conductive filaments at least partially embedded in the at one insulative substrate and extending at least mainly along both electrically parallel and geometrically parallel paths between the at least one first common terminal and the at least one second common terminal.

6 Claims, 4 Drawing Sheets

HEATING ASSEMBLIES PROVIDING A HIGH DEGREE OF UNIFORMITY OVER A SURFACE AREA

FIELD OF THE INVENTION

The present invention relates to heating assemblies and more particularly to heating blankets and the like for providing heating with a high degree of uniformity over a given surface area.

BACKGROUND OF THE INVENTION

The following U.S. patent documents are believed to represent the current state of the art:

U.S. Pat. Nos. 2,423,196; 3,947,618

SUMMARY OF THE INVENTION

The present invention seeks to provide an improved heating assembly. There is thus provided in accordance with a preferred embodiment of the present invention a uniform heating assembly including at least one first insulative substrate, at least one first common terminal, at least one second common terminal and a multiplicity of conductive filaments at least partially embedded in the at one insulative substrate and extending at least mainly along both electrically parallel and geometrically parallel paths between the at least one first common terminal and the at least one second common terminal.

There is also provided in accordance with another preferred embodiment of the present invention a uniform heating assembly including at least one first insulative substrate, at least one first terminal, at least one second terminal and a multiplicity of conductive filaments at least partially embedded in the at one insulative substrate and extending along both electrically parallel and geometrically parallel paths between the at least one first terminal and the at least one second terminal, elongate edges of adjacent parallel extending ones of the multiplicity of conductive filaments being separated from each other by less than 0.030 inches (0.762 mm).

Preferably, the uniform heating assembly also includes at least one second insulative substrate located over the multiplicity of conductive filaments.

Preferably, the multiplicity of conductive filaments generally do not cross over each other between the first and second terminals.

Preferably, adjacent edges of adjacent ones of the multiplicity of conductive filaments are separated by less than 0.030 inches (0.762 mm) along the geometrically parallel paths between the at least one first common terminal and the at least one second common terminal. More preferably, adjacent edges of adjacent ones of the multiplicity of conductive filaments are separated by less than 0.020 inches (0.508 mm) along the geometrically parallel paths between the at least one first common terminal and the at least one second common terminal. Even more preferably, adjacent edges of adjacent ones of the multiplicity of conductive filaments are separated by less than 0.010 inches (0.254 mm) along the geometrically parallel paths between the at least one first common terminal and the at least one second common terminal. Most preferably, adjacent edges of adjacent ones of the multiplicity of conductive filaments are separated by 0.008 inches (0.203 mm) along the geometrically parallel paths between the at least one first common terminal and the at least one second common terminal.

Preferably, the uniform heating assembly provides heating to a temperature in excess of 300 degrees F. with a temperature variation of less than 20 degrees F. over the extent of the heating blanket. More preferably, the uniform heating assembly provides heating to a temperature in excess of 300 degrees F. with a temperature variation of less than 17 degrees F. over the extent of the heating blanket.

There is further provided in accordance with yet another preferred embodiment of the present invention a method of manufacturing a heating assembly including at least partially embedding a multiplicity of conductive elements in at least one first insulative substrate in an arrangement whereby the filaments extend both electrically parallel and geometrically parallel to each other and connecting first and second ends of the multiplicity of conductive elements to respective first and second common terminals.

Preferably, the method also includes providing at least one second insulative substrate over the multiplicity of conductive elements, whereby the multiplicity of conductive elements are insulated from each other than at the common terminals.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
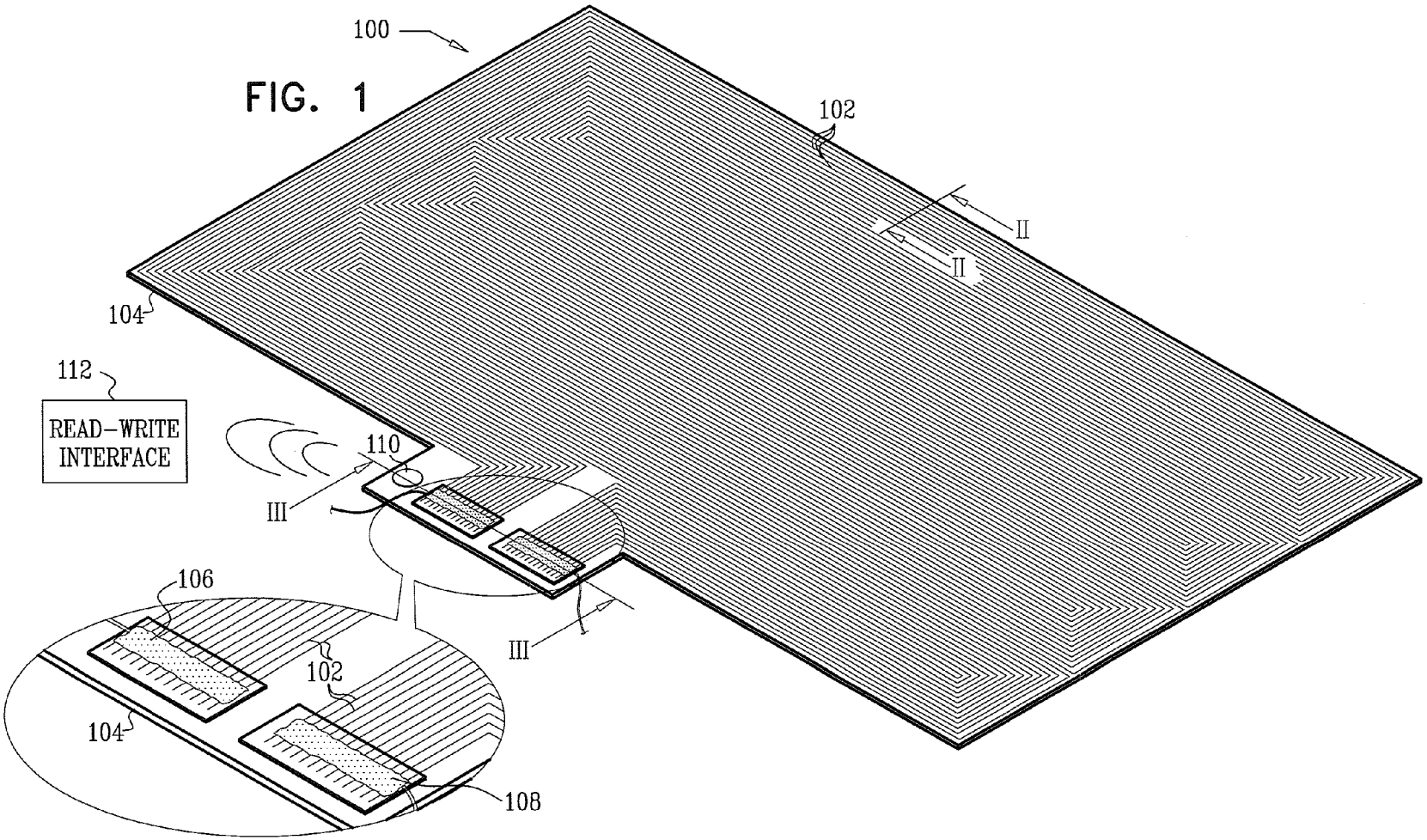
FIG. 1 is a simplified pictorial illustration of a heating blanket constructed and operative in accordance with a preferred embodiment of the present invention.

Reference is now made to FIG. 1, which is a simplified pictorial illustration of a heating blanket constructed and operative in accordance with a preferred embodiment of the present invention. As seen in FIG. 1, a heating blanket 100 includes a multiplicity of electrically conductive filaments 102 at least partially embedded in an insulative substrate 104. The insulative substrate 104 is preferably flexible, but need not necessarily be so.

In accordance with a preferred embodiment of the present invention, the conductive filaments 102 extend along both electrically parallel and geometrically parallel paths, as seen clearly in FIG. 1, between a first common terminal 106 and a second common terminal 108. Conductive filaments 102 are preferably formed of metal, but need not be so. More preferably, conductive filaments 102 are uninsulated metal wires. It is also a particular feature of the present invention that the conductive filaments 102 are separated from each other by less than 0.030 inches (0.762 mm). Preferably, the separation between adjacent edges of adjacent conductive filaments is 0.008 inches (0.203 mm). It is noted that the parallel paths of the conductive filaments 102 are not in a single straight line, but that a group of adjacent conductive filaments 102 maintain mutual parallelism therebetween both along straight portions and through various bends. It is a particular feature of the present invention that 30 or more mutually spaced uninsulated conductive filaments may be provided per linear inch.

It is also a particular feature of the present invention that crossovers of conductive filaments 102 are avoided.

A transponder 110, such as an RFID transponder, may be provided at any suitable location on the heating blanket 100. A suitable transponder is commercially available from OTI America, Inc., 2 Executive Drive, suite 740, Fort Lee, N.J. 07024, U.S.A. under part number Saturn 5000. Transponder 110 is in communication, preferably wireless communication, with a read/write interface 112. Transponder 110 preferably provides a tracking functionality, including providing information relating to heating blanket 100, such as manufacturer's information, blanket information including, for example, heater size, heater resistance, watts per square inch, operating voltage, and test results including, for example, heat uniformity test result and date tested.

First common terminal 106 and second common terminal 108 of heating blanket 100 are preferably coupled to a temperature controller (not shown) or other suitable device which governs the supply of electrical power to conductive filaments 102 for providing a highly uniform precisely controlled temperature output. Preferably, but not necessarily, 220 volt voltage is supplied to conductive filaments 102.

It is a particular feature of the present invention that, due to the tight spacing of the filaments 102, a temperature variation of less than 20 degrees F. over the extent of the heating blanket 100 may be realized.

In thermographic imaging tests performed by the applicant, a heating blanket constructed in accordance with a preferred embodiment of the present invention provided heating to a temperature in excess of 300 degrees F. with a temperature variation of less than 17 degrees F. over the extent of the heating blanket.

Figure 2A:
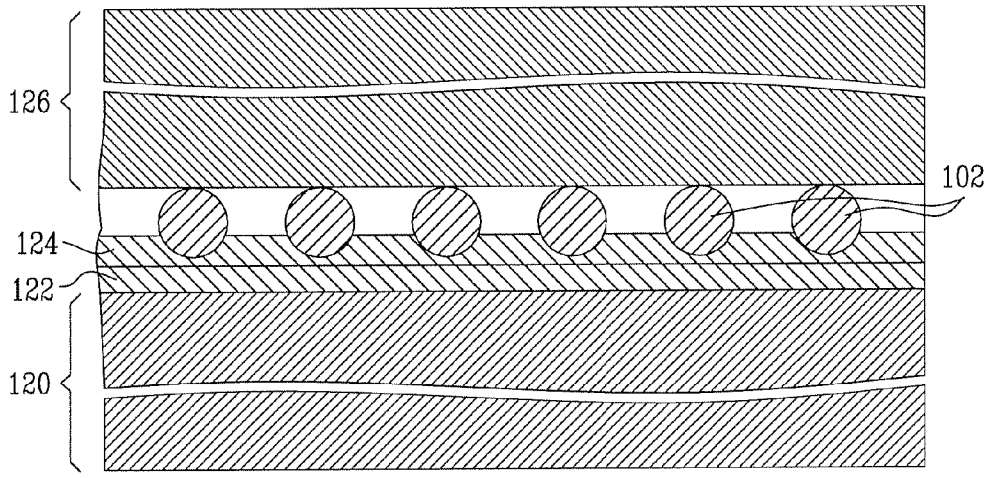
FIGS. 2A and 2B are simplified sectional illustrations taken along lines II-II in FIG. 1, showing two alternative embodiments of the present invention.

Reference is now made to FIG. 2A, which is a simplified sectional illustration, taken along lines II-II in FIG. 1, showing one preferred embodiment of the heating assembly of the present invention. As seen in FIG. 2A, the heating assembly comprises an electrically insulative base 120, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026. Two layers 122 and 124 of high temperature adhesive, preferably 0.002 inches (0.051 mm) in thickness, commercially available from Dielectric Polymers, Inc., 218 Race Street, Holyoke, Mass. 01040, U.S.A. under part number NT-1001, are formed over base 120.

In the illustrated embodiment of the present invention shown in FIG. 2A, conductive filaments 102 comprise resistance wires, preferably 38 AWG NiCr wire, which is commercially available from Hyndman Industrial Products, 3508 Independence Drive, Fort Wayne, Ind. 46808, U.S.A. under part number 38N8SP2.RWC, of diameter 0.004 inches (0.102 mm), which is partially embedded in layer 124. Alternatively, other suitable materials, such as Ni, alloy of Ni, alloy of Cr, tungsten, ceramic composite and carbon composite, may be employed for conductive filaments 102. Embedding of the conductive filaments 102 in the adhesive layer 124 is carried out using known techniques, such as those described in U.S. Pat. No. 3,674,602.

In a preferred embodiment of the present invention, embedding of the conductive filaments 102 is achieved using a suitable wiring machine, such as a T2000 wiring machine commercially available from PCK Technology, Inc., 181 Freeman Avenue, Islip, N.Y. 11751, U.S.A.

An electrically insulative layer 126, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026, is provided over embedded conductive filaments 102 and layer 124.

Figure 2B:
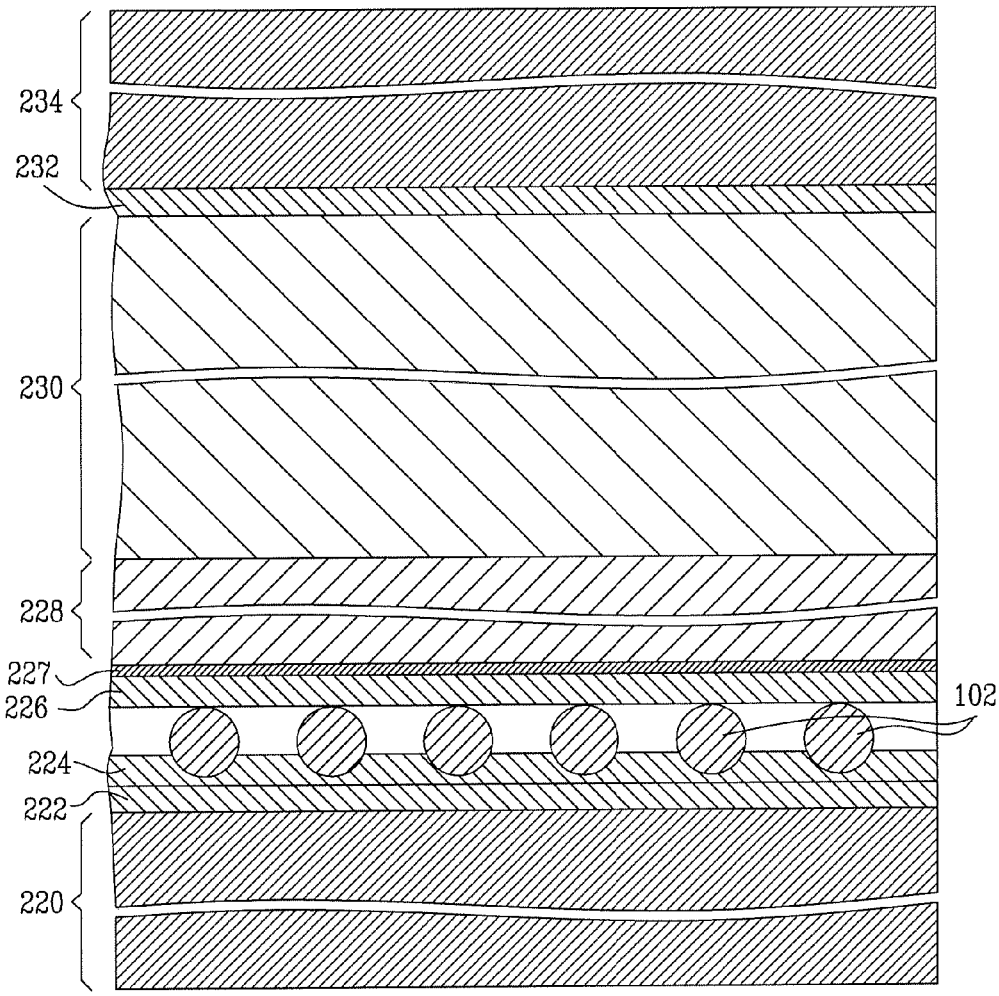

Reference is now made to FIG. 2B, which is a simplified sectional illustration, taken along lines II-II in FIG. 1, showing another preferred embodiment of the heating assembly of the present invention. As seen in FIG. 2B, the heating assembly comprises an electrically insulative base 220, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026. Two layers 222 and 224 of high temperature adhesive, preferably 0.002 inches (0.051 mm) in thickness, commercially available from Dielectric Polymers, Inc., 218 Race Street, Holyoke, Mass. 01040, U.S.A. under part number NT-1001, are formed over base 220.

In the illustrated embodiment of the present invention shown in FIG. 2B, conductive filaments 102 comprise resistance wires, preferably 38 AWG NiCr wire, which is commercially available from Hyndman Industrial Products, 3508 Independence Drive, Fort Wayne, Ind. 46808, U.S.A. under part number 38N8SP2.RWC, of diameter 0.004 inches (0.102 mm), which is partially embedded in layer 224. Alternatively, other suitable materials, such as Ni, alloy of Ni, alloy of Cr, tungsten, ceramic composite and carbon composite, may be employed for conductive filaments 102. Embedding of the conductive filaments 102 in the adhesive layer 224 is carried out using known techniques, such as those described in U.S. Pat. No. 3,674,602.

In a preferred embodiment of the present invention, embedding of the conductive filaments 102 is achieved using a suitable wiring machine, such as a T2000 wiring machine commercially available from PCK Technology, Inc., 181 Freeman Avenue, Islip, N.Y. 11751, U.S.A.

A third layer 226 of high temperature adhesive, preferably 0.002 inches (0.051 mm) in thickness, commercially available from Dielectric Polymers, Inc., 218 Race Street, Holyoke, Mass. 01040, U.S.A. under part number NT-1001, is formed over embedded conductive filaments 102 and layer 224. A layer 227 of B100 high temperature insulative film, preferably of thickness 0.001 inches (0.025 mm), commercially available from Rogers Corporation, One Technology Drive, Rogers, Conn. 06263, U.S.A. under part number 7200B100, is preferably formed over layer 226.

A layer 228 of treated epoxy prepreg, preferably of thickness 0.010 inches (0.254 mm), commercially available from J.D. Lincoln Inc., 851 West 18th Street, Costa Mesa, Calif. 92627, U.S.A. under part number L-529, is formed over layer 227. A layer 230 of a heat spreading material, such as copper foil, preferably of thickness 0.707 inches (17.958 mm), available from Oak-Mutsui Inc., Camden, S.C. 29020, U.S.A. under part number 1808700225, is provided over layer 228. Alternatively, other suitable materials, such as aluminum or ceramic may be employed for a heat spreading material.

A layer 232 of high temperature adhesive, preferably 0.002 inches (0.051 mm) in thickness, commercially available from Dielectric Polymers, Inc., 218 Race Street, Holyoke, Mass. 01040, U.S.A. under part number NT-1001, is formed over layer 230. An electrically insulative layer 234, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026, is provided over layer 232.

Figure 3A:
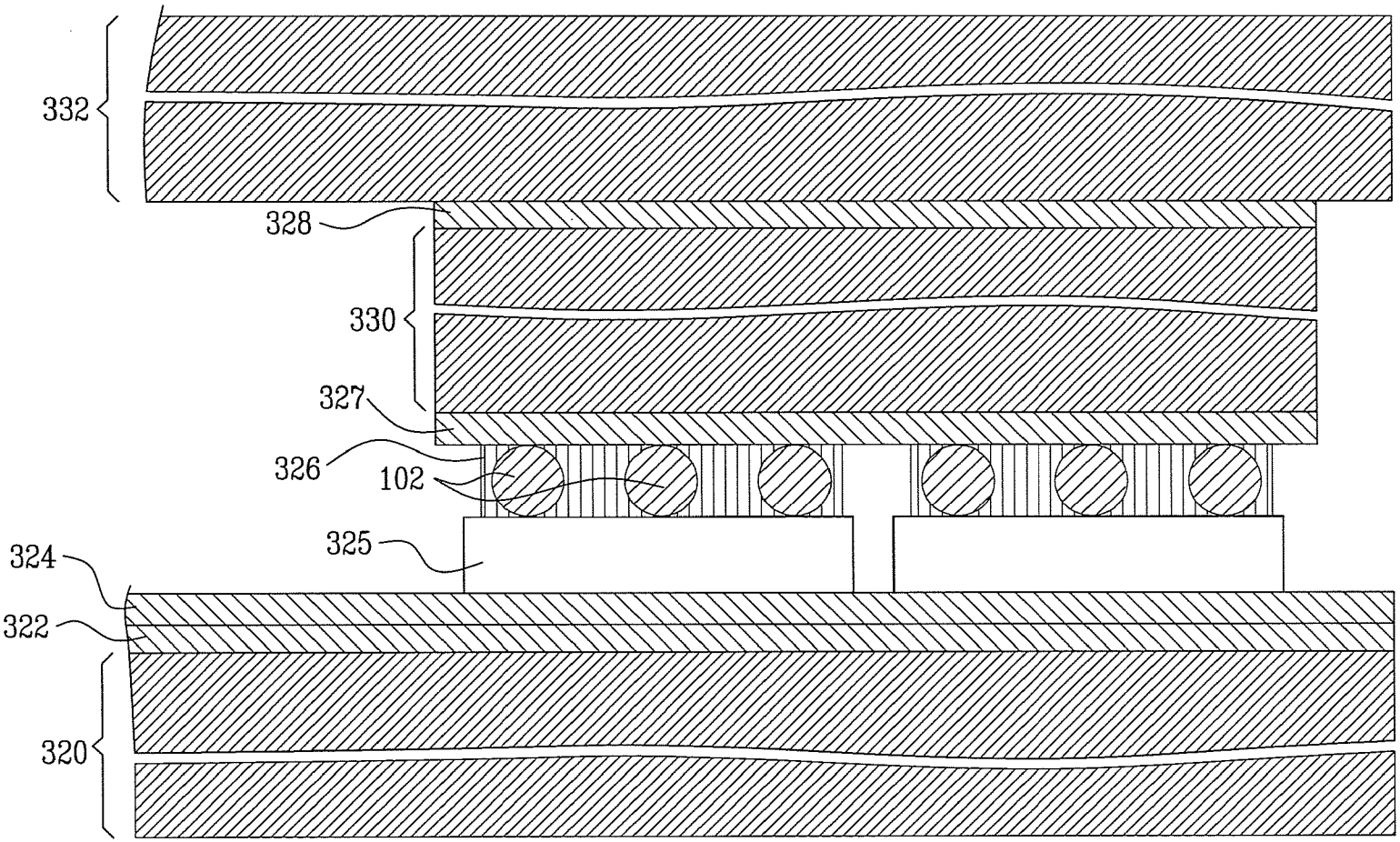
FIGS. 3A and 3B are simplified sectional illustrations taken along lines III-III in FIG. 1, showing two alternative embodiments of the present invention.

Reference is now made to FIG. 3A, which is a simplified sectional illustration, taken along lines III-III in FIG. 1, showing the terminal region of the embodiment of FIG. 2A. As seen in FIG. 3A, the heating assembly comprises an electrically insulative base 320, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026. Two layers 322 and 324 of high temperature adhesive, preferably each 0.002 inches (0.051 mm) in thickness, commercially available from Dielectric Polymers, Inc., 218 Race Street, Holyoke, Mass. 01040, U.S.A. under part number NT-1001, are formed over base 320. A layer 325 of copper bus bar, preferably of thickness 0.005 inches (0.127 mm), which is commercially available from Maximum Velocity, Inc., 11782 North 91st Avenue, Suite 3, Peoria, Ariz. 85345, U.S.A. under part number KS6020, is provided over layer 324.

In the illustrated embodiment of the present invention shown in FIG. 3A, conductive filaments 102 comprise resistance wires, preferably 38 AWG NiCr wire, which is commercially available from Hyndman Industrial Products, 3508 Independence Drive, Fort Wayne, Ind. 46808, U.S.A. under part number 38N8SP2.RWC, of diameter 0.004 inches (0.102 mm), which are adhered to copper layer 325 using a solder layer 326, preferably formed of a clear flux solder, such as clear flux solder 60/40 commercially available from RadioShack Corporation, 300 Radio Shack Circle, Fort Worth, Tex. 76102, U.S.A. under part number 64-018E. Alternatively, other suitable materials, such as Ni, alloy of Ni, alloy of Cr, tungsten, ceramic composite and carbon composite, may be employed for conductive filaments 102. Alternatively, conductive filaments 102 may be adhered to copper layer 325 by welding, mechanical attachment or any other suitable technique.

Two layers 327 and 328 of high temperature adhesive, preferably 0.002 inches (0.051 mm) in thickness, commercially available from Dielectric Polymer, Inc. under part number NT-1001, are formed over embedded conductive filaments 102 and solder layer 326. An electrically insulative layer 330, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026, is provided between layers 327 and 328. An additional electrically insulative layer 332, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026, is provided over layer 328.

Figure 3B:
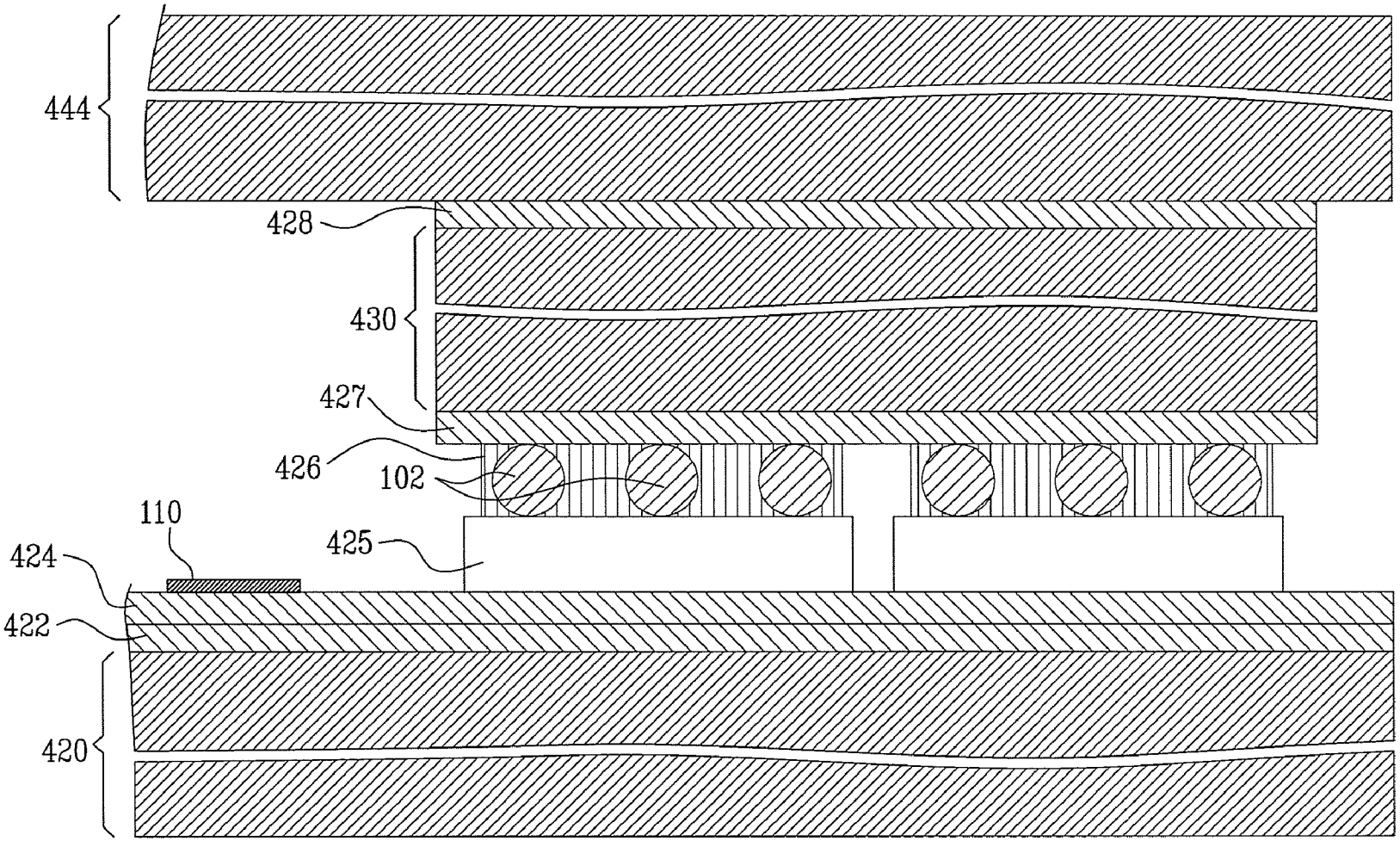

Reference is now made to FIG. 3B, which is a simplified sectional illustration, taken along lines III-III in FIG. 1, showing the terminal region of the embodiment of FIG. 2B. As seen in FIG. 3B, the heating assembly comprises an electrically insulative base 420, preferably formed of silicon rubber, preferably of thickness 0.028 inches (0.711 mm), which is commercially available from Arlon Silicon Technologies Division, 1100 Governor Lea Road, Bear, Del. 19701, U.S.A. under part number 56586R026. Two layers 422 and 424 of high temperature adhesive, preferably 0.002 inches (0.051 mm) in thickness, commercially available from Dielectric Polymers, Inc., 218 Race Street, Holyoke, Mass. 01040, U.S.A. under part number NT-1001, are formed over base 420. A layer 425 of copper bus bar, preferably of thickness 0.005 inches (0.127 mm), which is commercially available from Maximum Velocity, Inc., 11782 North 91st Avenue, Suite 3, Peoria, Ariz. 85345, U.S.A. under part number KS6020, is provided over layer 424.

In the illustrated embodiment of the present invention shown in FIG. 3B, conductive filaments 102 comprise resistance wires, preferably 38 AWG NiCr wire, which is commercially available from Hyndman Industrial Products, 3508 Independence Drive, Fort Wayne, Ind. 46808, U.S.A. under part number 38N8SP2.RWC, of diameter 0.004 inches (0.102 mm), which are adhered to copper layer 425 using a solder layer 426, preferably formed of a clear flux solder, such as clear flux solder 60/40 commercially available from RadioShack Corporation, 300 Radio Shack Circle, Fort Worth, Tex. 76102, U.S.A. under part number 64-018E. Alternatively, other suitable materials, such as Ni, alloy of Ni, alloy of Cr, tungsten, ceramic composite and carbon composite, may be employed for conductive filaments 102. Alternatively, conductive filaments 102 may be adhered to copper layer 425 by welding, mechanical attachment or any other suitable technique.

Two layers 427 and 428 of high temperature adhesive, preferably 0.002 inches (0.051 mm) in thickness, commercially available from Dielectric Polymer, Inc. under part number NT-1001, are formed over embedded conductive filaments 102 and solder layer 426. An electrically insulative layer 430, preferably formed of silicon rubber, preferably of thickness 0.028 inches (0.711 mm), which is commercially available from Arlon Silicon Technologies Division of 1100 Governor Lea Road, Bear, Del. 19701, U.S.A. under part number 56586R026, is provided between layers 427 and 428.

An electrically insulative layer 444, preferably formed of silicon rubber, preferably of thickness 0.028 inches, which is commercially available from Arlon Silicon Technologies Division, 1100 Governor Lea Road, Bear, Del. 19701, U.S.A. under part number 56586R026, is provided over layer 428.

As seen in FIG. 3B, transponder 110 is adhered to adhesive layer 424 and overlaid by additional layer 444. As seen further in FIG. 3B, layers 425, 426, 427, 428 and 430 do not overlie transponder 110.

It is appreciated that FIGS. 2A-3B are not necessarily drawn to scale and that the preferred thicknesses of various material layers shown therein are as described hereinabove.

It will be appreciated by persons skilled in the art that the present invention is not limited to what has been particularly shown and described hereinabove. Rather the scope of the invention includes both combinations and subcombinations of the various features described hereinabove as well as modifications and variations thereof which would occur to persons skilled in the art upon reading the foregoing description and which are not in the prior art.

The invention claimed is:

1. A uniform heating assembly comprising:

at least one first insulative substrate;

a first common terminal;

a second common terminal, said first common terminal and said second common terminal being located adjacent the same edge of said insulative substrate;

a multiplicity of continuous conductive filaments at least partially embedded in said at least one first insulative substrate and extending at least mainly along both electrically parallel and geometrically parallel paths, each of said multiplicity of continuous conductive filaments extending between said first common terminal and said second common terminal, said multiplicity of conductive filaments generally not crossing over each other between said first and second terminals, adjacent edges of adjacent ones of said multiplicity of conductive filaments being separated by less than 0.030 inches (0.762 mm) along said geometrically parallel paths between said first common terminal and said second common terminal, said electrically parallel and geometrically parallel paths including straight portions and bent portions; and at least one second insulative substrate located over said multiplicity of conductive filaments, said uniform heating assembly providing heating to a temperature in excess of 300 degrees F. with a temperature variation of less than 20 degrees F. over the extent of the heating blanket.

2. A uniform heating assembly according to claim 1 and wherein adjacent edges of adjacent ones of said multiplicity of conductive filaments are separated by less than 0.020 inches (0.508 mm) along said geometrically parallel paths between said first common terminal and said second common terminal.

3. A uniform heating assembly according to claim 1 and wherein adjacent edges of adjacent ones of said multiplicity of conductive filaments are separated by less than 0.010 inches (0.254 mm) along said geometrically parallel paths between said first common terminal and said second common terminal.

4. A uniform heating assembly according to claim 1 and wherein adjacent edges of adjacent ones of said multiplicity of conductive filaments are separated by 0.008 inches (0.203 mm) along said geometrically parallel paths between said first common terminal and said second common terminal.

5. A uniform heating assembly according to claim 1 and wherein said uniform heating assembly provides heating to a temperature in excess of 300 degrees F. with a temperature variation of less than 17 degrees F. over the extent of the heating blanket.

6. A uniform heating assembly according to claim 1 and wherein said multiplicity of conductive filaments comprise a multiplicity of resistance wires.

* * * * *